United States Patent [19]

Stotz et al.

[11] 4,235,215

[45] Nov. 25, 1980

[54] PRELIMINARY HEATING CONTROL INSTALLATION FOR AIR-COMPRESSING INTERNAL COMBUSTION ENGINES

[75] Inventors: Manfred Stotz, Aichwald; Gerhard Komander, Altbach; Wolfgang Hilpert, Stuttgart, all of Fed. Rep. of Germany

[73] Assignee: Daimler-Benz Aktiengesellschaft, Fed. Rep. of Germany

[21] Appl. No.: 955,262

[22] Filed: Oct. 27, 1978

[30] Foreign Application Priority Data

Nov. 11, 1977 [DE] Fed. Rep. of Germany ..... 2750464

[51] Int. Cl.[3] ..... F02N 17/00

[52] U.S. Cl. ..... 123/179 H; 123/179 B; 123/179 BG

[58] Field of Search ..... 123/179 H, 179 B, 122 G, 123/122 F, 179 BG

[56] References Cited

U.S. PATENT DOCUMENTS

| | | | |
|---|---|---|---|
| 3,551,686 | 12/1970 | Koehler et al. | 123/179 H |
| 4,075,998 | 2/1978 | Krauss et al. | 123/179 H |

FOREIGN PATENT DOCUMENTS

| | | | |
|---|---|---|---|
| 1954630 | 5/1970 | Fed. Rep. of Germany | 123/179 H |
| 2242421 | 11/1974 | Fed. Rep. of Germany | 123/179 H |
| 2734718 | 2/1979 | Fed. Rep. of Germany | 123/179 H |

*Primary Examiner*—P. S. Lall

*Attorney, Agent, or Firm*—Craig & Antonelli

[57] ABSTRACT

A preliminary heating control installation for air-compressing internal combustion engines, especially in motor vehicles, with a device for the control of the preliminary heating time as a function of engine temperature and of a time limit, with a relay whose energizing winding is connected in the heating circuit and whose contact controls an indicating lamp, and with an additional circuit that detects the failure of at least one or several heater plugs and renders this defect visible by engagement of the indicating lamp during the duration of the starting operation or therebeyond.

16 Claims, 3 Drawing Figures

PRELIMINARY HEATING CONTROL INSTALLATION FOR AIR-COMPRESSING INTERNAL COMBUSTION ENGINES

The present invention relates to a preliminary heating control installation for air-compressing internal combusiton engines, especially in motor vehicles, with a device for the control of the preliminary heating time in dependence on the engine temperature and of a time limit, and with a relay whose energizing winding is connected in the heating circuit and whose contact controls an indicating lamp.

A preliminary heating control installation with a series-connection of a preliminary heating starter switch of an energizing winding of a relay and of at least one glow or preliminary heater plug, whereby a contact of the relay and a signalling device are connected in series with the energizing winding and the glow or heater plug and whereby a reed relay with a normally closed contact is provided as relay, has already been proposed in a prior patent application filed in the name of the assignee herein. Such a circuit is used in series production of Diesel motor vehicles having glow or heater plugs connected in series and with a control of the preliminary heating period of time in dependence on the engine temperature by means of an NTC-evaluation circuit and with a time gate, with a so-called safety disengaging circuit, as will be described more fully hereinafter and as is illustrated in FIG. 1 herein. However, such a circuit is not usable without changes for parallelly connected rod-type glow or heater plugs which have a current requirement that decreases with the preliminary heating time. Additionally, a defect in the preliminary heating installation is ascertainable only during the preliminary heating operation by the failure of the indicating lamp to light up.

It is the aim of the present invention to render the aforementioned preliminary heating control installation usable also for parallelly connected rod-type glow or heater plugs and to so improve the same that a defect is also recognizable unequivocally after the termination of the preliminary heating operation, and that the preliminary heating advance time is not disturbed by the control circuit.

The underlying problems are solved according to the present invention in that an additional circuit is provided, which detects the failure of one or several glow or heater plugs and which renders this failure clearly visible by the engagement of the indicating lamp during the duration of the starting operation or therebeyond.

According, it is an object of the present invention to provide a preliminary heating control installation for air-compressing internal combustion engines which avoids by simple means the aforementioned shortcomings and drawbacks encountered in the prior art.

Another object of the present invention resides in a preliminary heating control system for air-compressing internal combustion engines which can be used also for parallelly connected rod-type heater plugs.

A further object of the present invention resides in a preliminary heating control installation for air-compressing internal combustion engines which is capable of detecting any failures in the installation also after termination of the preliminary heating operation.

Still a further object of the present invention resides in a preliminary heating control system for air-compressing internal combustion engines of the type described above which effectively achieves the aforementioned aims and objects without interfering with the advance time of the preliminary heating operation.

These and other objects, features and advantages of the present invention will become more apparent from the following description when taken in connection with the accompanying drawing which shows, for purposes of illustration only, two embodiments in accordance with the present invention, and wherein.

Figure 1:
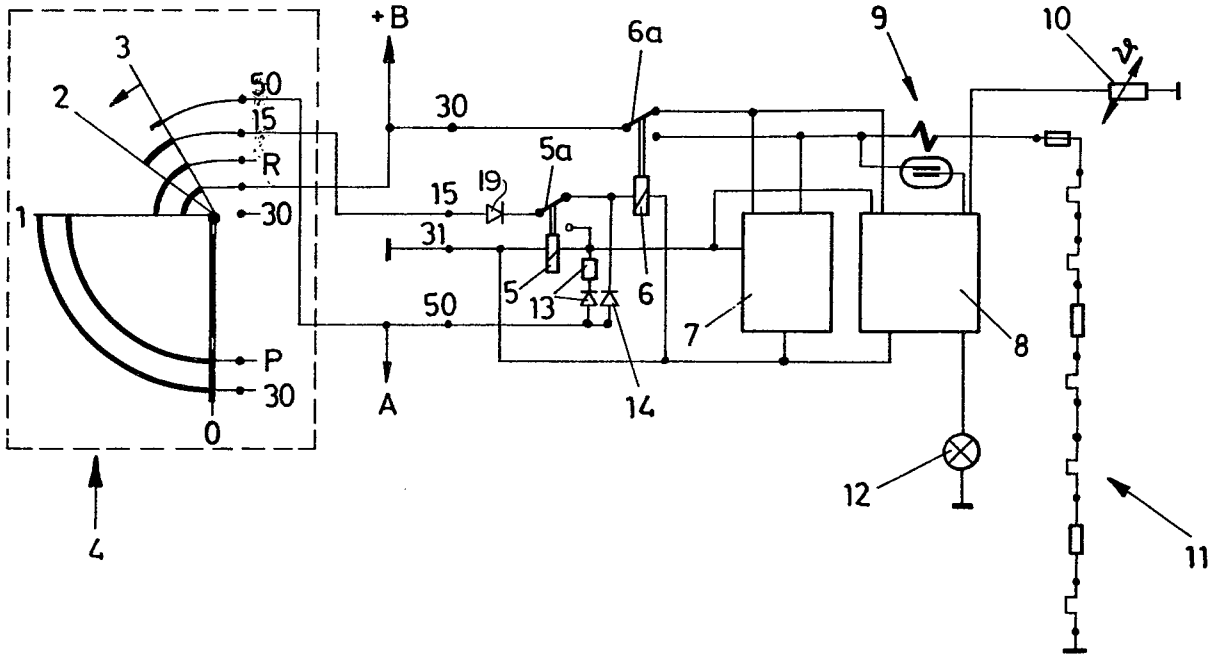
FIG. 1 is a schematic circuit diagram of a preliminary heating control installation as described in a prior patent application.

Referring now to the drawing wherein like reference numerals are used throughout the various views to designate like parts, and more particularly to FIG. 1, the aforementioned circuit of a preliminary heating control installation as described in a prior patent application is schematically shown in this figure. The same reference numerals are used also in FIGS. 2 and 3 to designate corresponding parts. The positive terminal +B of the battery, the terminal 30, is connected by way of a conventional ignition lock generally designated by reference numeral 4 in the position O=Off, position 1=Parking Position, position 2=Preliminary Heating, respectively, Driving Position, and position 3=Unstable Starting Position, at terminals 30, 15 and 50 with the different current loads in a known manner. The permanently connected loads are connected with terminal 30 while the so-called daylight loads required in the preliminary heating-/driving position are connected to terminal 15 and the loads required for starting are connected to the terminal 50.

The preliminary heating control installation of FIG. 1 consists of a first relay 5 having a switching contact 5*a*, of a second relay 6 having a switching contact 6*a*, of a conventional safety turn-off circuit 7, of a conventional NTC-evaluating circuit 8, as well as of a reed relay generally designated by reference numeral 9 and of an indicating lamp 12; an NTC-resistance 10 is connected with the NTC-evaluating circuit 8 while the glow or heater plugs generally designated by reference numeral 11 are connected in series with each other and with the energizing winding of the reed relay 9.

If the ignition lock 4 is actuated into the preliminary heating-/driving position 2, then current flows from terminal 15 by way of diode 19 and the contact 5*a* in the normal position, i.e., with relay 5 de-energized, through the energizing winding of relay 6. Relay 6 is energized as a result thereof, switching its contact 6*a* from the position illustrated in FIG. 1, so that current flows from terminal 30 by way of the changed-over or switched operating contact 6*a*, the energizing winding of reed relay 9 to the series-connected heater or glow plugs 11 as well as by way of the now closed reed contact to the NTC-evaluation circuit 8. In the rest position of the relay contact 6*a*, i.e., with relay 6 de-energized, a condenser (not shown) in the evaluation circuit 8 was charged, which is again discharged in the preliminary heating-/driving position 2 of the ignition lock 4 by way of the temperature-dependent NTC-resistance 10. This NTC-resistance 10 has the higher a resistance the lower the temperature of the engine. During the discharge time of the condenser up to a predetermined voltage threshold, the indicating lamp 12 lights up. The extinction of the indicating lamp 12 is a signal for the fact that a sufficient preliminary heating has taken place and one is now able to start the engine. However, current continues to flow through the glow or heater plugs 11. During the starting in the position 3 of the ignition lock 4, current flows by way of terminal 50 to the starter A and to the energizing winding or relay 5 by way of the series circuit 13 including a diode and resistance. The relay 5 is energized and remains self-holding in this position by way of the switching contact 5*a* establishing a connection from terminal 15 through diode 19 and contact 5*a* with relay 5 energized until the ignition lock 4 is turned off. As long as the starter A is actuated, the relay 6 remains energized by way of the diode 14 and drops off, i.e., becomes de-energized, only after termination of the starting operation, as a result of which the preheating is terminated. If after the extinction of the indicating lamp 12 one does not commence the starting operation of the engine, then the preliminary heating is continued until the safety turn-off circuit 7 adjusted to a predetermined time internal, energizes the relay 5, as a result of which relay 6 drops off immediately and the preliminary heating is terminated. If, however, too little or no current flows through the preliminary heating circuit as a result of a defect, then the indicating lamp 12 does not light up.

Such an installation cannot be applied without change to more recently used rod-type glow or heater plugs which are connected in parallel and which additionally do not have a constant heater current—the heater current in these rod heater plugs has a higher value at the beginning of the preliminary heating operation which is lowered to a predetermined value as a function of time.

Figure 2:
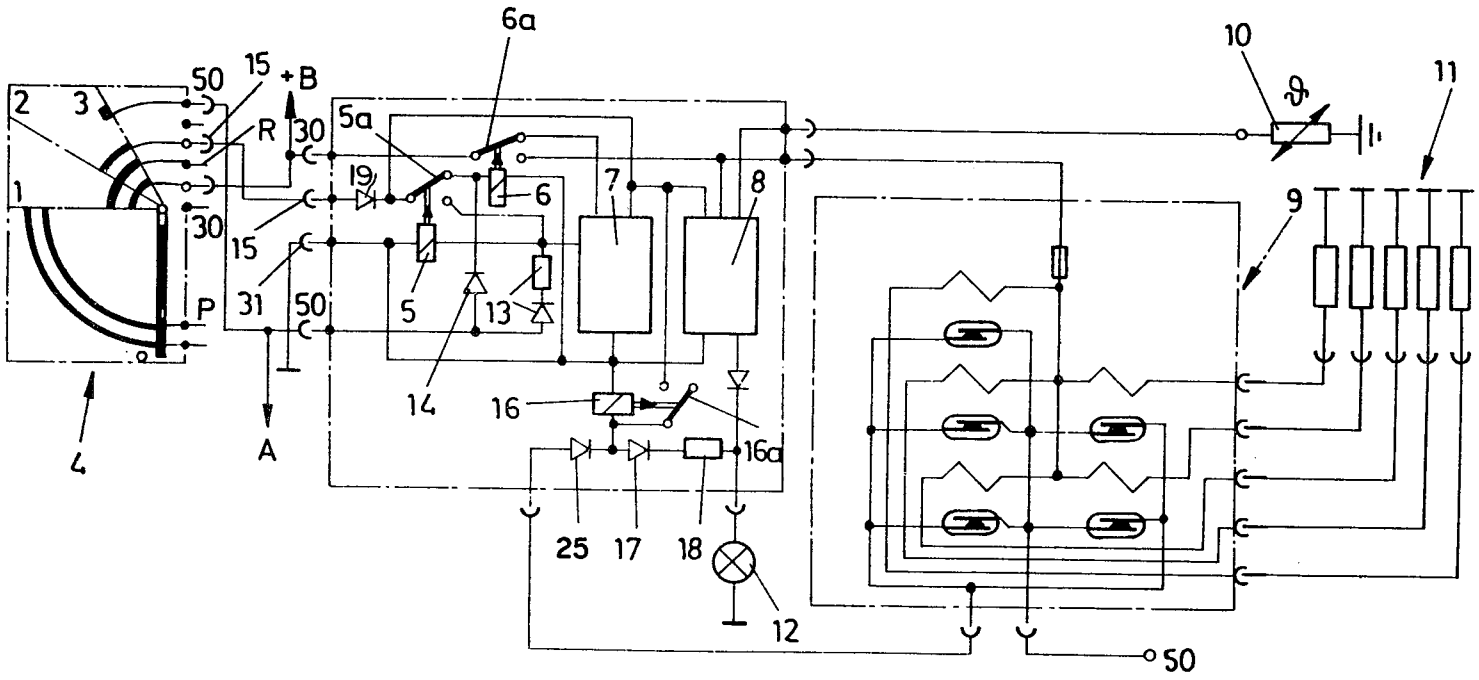
FIG. 2 is a schematic diagram of a preliminary heating control installation in accordance with the present invention with a self-holding relay and contacts in parallel connection.

FIG. 2 illustrates schematically a first embodiment according to the present invention. Differing from FIG. 1, the glow or heater plugs 11 of the installation of FIG. 2 are connected in parallel and the energizing winding of one reed relay arrangement 9 is connected in series with each rod-type glow or heater plug 11. The contacts of these relays 9 are normally closed contacts, i.e., they open upon energization of the energizing windings of the reed relays, and are connected in parallel to one another. The contacts of the relays 9 are connected, on the one hand, with the positive terminal of the starter current circuit—terminal 50—and, on the other, extend by way of a diode 25 to the energizing winding of a self-holding relay 16 and in parallel to this self-holding relay 16 by way of a further diode 17 and a resistance 18 to the indicating lamp 12. The normally open contact 16*a* of the self-holding relay 16, when closed, is supplied with battery voltage from terminal 15 by way of diode 19. If the preliminary heating installation is in order, i.e., functions properly, then it operates as the circuit according to FIG. 1. Current flows through the energizing windings of all reed relays 9 and the opened contacts thereof interrupt the connection between terminal 50 and the self-holding relay 16.

If, however, no current flows through at least one rod heater plug 11, then the coordinated reed contact 9 remains closed and a current flows during starting from terminal 50 by way of the closed reed contact and the diode 25 through the energizing winding of the self-holding relay 16. The latter attracts its armature and remains energized so that current flows from terminal 15 by way of normally open contact 16*a*, now closed, diode 17 and resistance 18 through the indicating lamp 12 and the latter lights up with an intensity or brightness reduced by the resistance 18. However, during the preliminary heating the indicating lamp 12 had full light intensity up to the extinction, when sufficient preliminary heating had taken place. The continuous lighting up during the drive reminds the driver to cause the defect to be eliminated as soon as possible.

Figure 3:
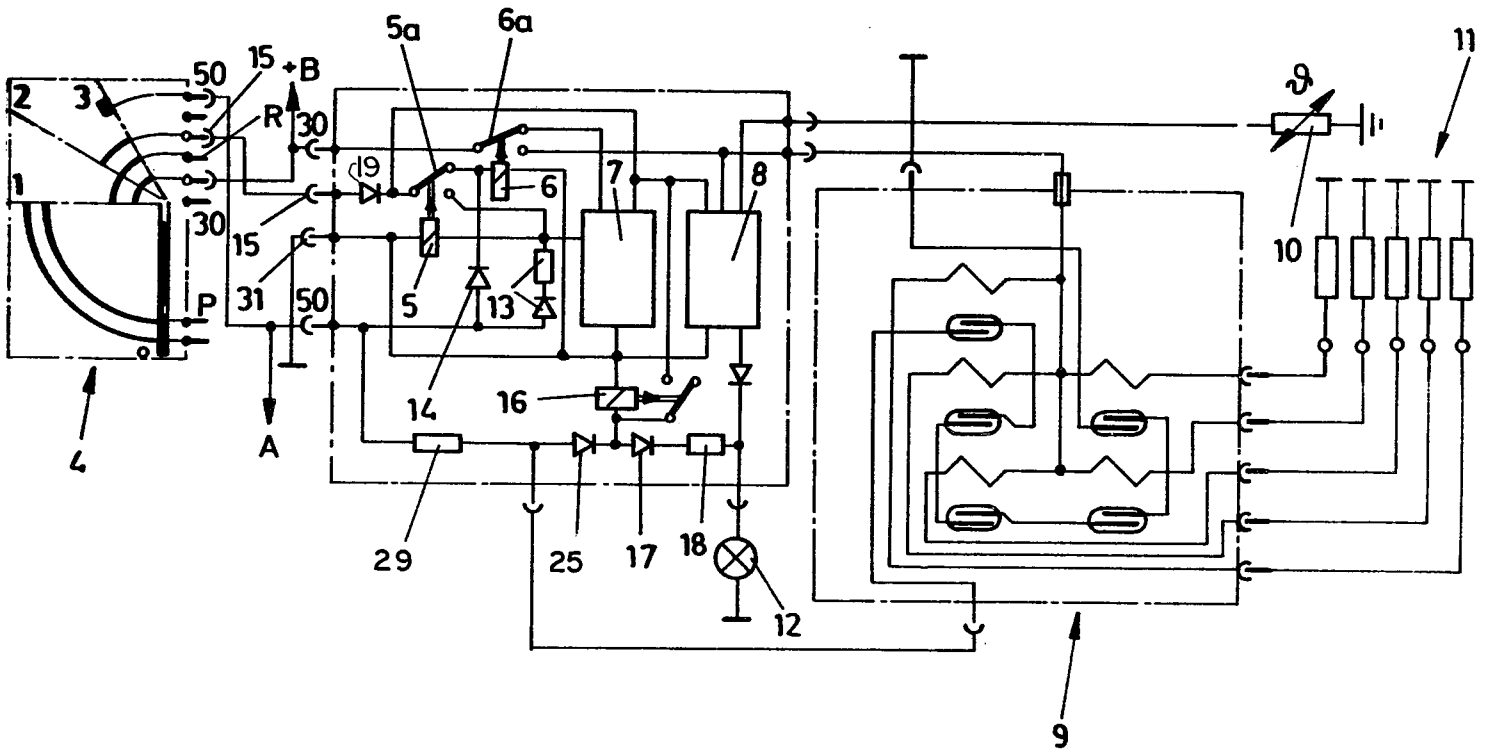
FIG. 3 is a schematic diagram of a preliminary heating control installation in accordance with the present invention with series connected contacts.

FIG. 3 illustrates a second embodiment of the present invention, whereby the contacts of the reed relays 9 are constructed as normally open contacts and are connected in series with each other. This series circuit of the relay contacts is connected on the one side with the negative terminal of the battery and leads on the other side, on the one hand, by way of diode 25 to the self-holding relay 16 already described in connection with FIG. 2, and on the other, by way of resistance 29 to the starter terminal 50. If all heater plugs 11 operate properly, then all reed contacts are closed during the preliminary heating and therewith the energizing circuit of the self-holding relay 16 is short-circuited so that the self-holding relay 16 cannot attract its armature during starting. Only if as a result of a defect in at least one heater plug the coordinated reed contact does not close, the self-holding relay 16 can attract its armature during starting as a result of its energization and the indicating lamp 12 can light up with reduced brightness.

The described circuits may also be modified at any time in such a manner that the mechanical circuit (relay 16) is replaced by electronic components of known type (transistors or integrated circuits). These circuits are so constructed that they become active (conducting) with the beginning of the starter current (terminal 50) and produce an output signal at the input either in response to positive potential, negative potential or no potential (opening of the contact).

The described circuits can also be modified without difficulty in such a manner that upon response of the control circuit, the indicating lamp lights up either for a predetermined time interval or also blinks or flashes, i.e., lights up intermittently, which is particularly meaningful. Also the use of a single reed relay with a normally closed or with a normally open contact is feasible within the scope of the present invention, whereby the energizing winding is connected in series with the parallelly connected plugs. The adjustment of the current threshold for the attraction or energization of the relay is to be carried out carefully in this case—by reason of the non-constant current and the specimen deviations.

Finally, the described circuits are also utilizable for the customary series—connected glow or heater plugs, whereby also only a single reed relay is required, and without having to change the circuit.

While we have shown and described two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A preliminary heating control installation for air-compressing internal combustion engines, comprising control means for controlling the preliminary heating time in dependence on engine temperature and on a time limit, heating current circuit means including at least one heater plug means, relay means having a winding connected in the heating current circuit means and contact means controlling an indicating lamp means, characterized in that an additional circuit means is provided, which detects the failure of at least one heater plug means and which renders this failure visible by engagement of the indicating lamp means at least substantially during the duration of the starting operation.

2. A preliminary heating control installation according to claim 1, characterized in that the additional circuit means detects the failure of several heater plug means.

3. A preliminary heating control installation according to claim 1 or 2, characterized in that the additional circuit means is operable to render the failure of the heater plug means visible beyond the duration of the starting operation.

4. A preliminary heating control installation according to claim 1, characterized in that the heater plug means are connected in parallel and in that the energizing winding of a relay means is connected in the heating circuit means of each heater plug means.

5. A preliminary heating control installation according to claim 4, characterized in that the relay contacts of the relay means are constructed as normally closed contacts and are connected in parallel to one another.

6. A preliminary heating control installation according to claim 4, characterized in that the relay contacts of the relay means are constructed as normally open contacts and are connected in series with one another.

7. A preliminary heating control installation according to claim 1, characterized in that a self-holding circuit means is operable to be engaged with the engagement of the indicating lamp means, which holds the indicating lamp means turned-on.

8. A preliminary heating control installation according to claim 7, characterized in that the engagement of the indicating lamp means takes place intermittently by the additional circuit means.

9. A preliminary heating control installation according to claim 7, characterized in that the self-holding circuit means is provided with a timing means.

10. A preliminary heating control installation according to claim 1, characterized in that the heater plug means are connected in parallel and the energizing winding of a relay means operating at a predetermined current strength is connected in the common heating current conductor of the current circuit means.

11. A preliminary heating control installation according to claim 10, characterized in that the last-mentioned relay means is energized at the predetermined current strength.

12. A preliminary heating control installation according to claim 10, characterized in that the last-mentioned relay means is de-energized at the predetermined current strength.

13. A preliminary heating control installation according to claim 1, characterized in that the relay means is formed by at least one reed relay.

14. A preliminary heating control installation according to claim 1, 4, 5 or 6, characterized in that the relay means are reed relay means.

15. A preliminary heating control installation according to claim 1, characterized in that the engagement of the indicating lamp means takes place intermittently by the additional circuit means.

16. A preliminary heating control installation for air-compressing internal combustion engines, comprising control means for controlling the preliminary heating time in dependence on engine temperature and on a time limit, heating current circuit means including at least one heater plug means, relay means having a winding connected in the heating current circuit means and contact means for controlling an indicating lamp means, and additional circuit means for detecting the failure of at least one heater plug means, the additional circuit means being responsive to the detection of the failure of at least one heater plug means for enabling operation of the indicating lamp means at least substantially during the duration of the starting operation of the air-compressing internal combustion engine so as to visibly indicate the failure of at least one heater plug means after the preliminary heating operation.

* * * * *